United States Patent [19]

Poehlein et al.

[11] Patent Number: 4,875,611

[45] Date of Patent: Oct. 24, 1989

[54] ROLL MEDIA FEED ROLL SYSTEM

[75] Inventors: Raymond E. Poehlein, Fairport; Franklin S. Reese, Victor, both of N.Y.

[73] Assignee: Xerox Corporation, Stamford, Conn.

[21] Appl. No.: 131,066

[22] Filed: Dec. 10, 1987

[51] Int. Cl.[4] ..... B65H 20/02

[52] U.S. Cl. ..... 226/186; 226/181; 226/191

[58] Field of Search ..... 226/181, 186, 187, 190, 226/191

[56] References Cited

U.S. PATENT DOCUMENTS

| | | | |
|---|---|---|---|
| 3,135,448 | 6/1964 | Wilson | 226/186 X |
| 3,363,816 | 1/1968 | Maddock | 226/186 |
| 3,411,686 | 11/1968 | Bender | 226/186 X |
| 3,834,861 | 9/1974 | McCarroll | 226/186 X |
| 3,893,662 | 7/1975 | Boyd | 271/10 |
| 4,007,865 | 2/1977 | Crandall | 226/17 |
| 4,077,137 | 3/1978 | Edgington et al. | 226/186 X |
| 4,223,203 | 9/1980 | Elter | 219/216 |
| 4,559,855 | 12/1985 | Schieck | 83/425.3 |

*Primary Examiner*—John Petrakes

[57] ABSTRACT

A copy media feed system includes two pair of feed rolls which are horizontally aligned to form nip areas to engage the media. Each feed roll pair comprises one drive roll and one idler roll. For one pair, the drive roll is an elastomer-covered, high friction roll and the idler roll is a hard, roll. For the second pair the drive roll is a hard, high friction roll and the idler roll is an elastomer-covered roll. This arrangement provides accurate control of the media velocity.

3 Claims, 3 Drawing Sheets

ROLL MEDIA FEED ROLL SYSTEM

BACKGROUND OF THE INVENTION

This invention relates to a system for feeding web media from a supply roll at a controlled velocity.

There are numerous applications wherein a web media must be unwound from a supply roll and fed into a system which operates on the media in some way. Printers and plotters are known in the art which are capable of producing copies of large documents such as engineering drawings, blueprints and the like. An example of such a machine is the Xerox 2510. The image-recording media, typically paper, is supplied in roll form by winding the paper about an inner core thereby forming a roll assembly. The roll assembly is supported in an axial position so that the paper can be unrolled in a generally flat condition and is then fed into the paper path of the particular document reproduction system. A requirement for any media supply system, emphasized for a system reproducing large documents, such as 36 inch engineering drawings, is to move the paper at a constant, controlled velocity. Deviations from the optimum process velocity alter the system timing relationships resulting in undesirable deviations in the output.

Various prior art techniques are known to unwind web media from a supply roll at a constant velocity. One approach is to feed the paper into two pairs of drive rollers. Each roll pair consists of an elastomer-covered, high-friction drive roll and a hard idler roll. This arrangement is shown in FIG. 1. A supply system 2, shown in side view, allows web media 3 to be fed from a media supply roll 4. The leading edge of the web is fed between two pairs of rolls 5. Each roll pair comprises an elastomer, high friction drive roll 6 and a hard idler roll 7. Each roller pair defines a nip area at its interface. FIG. 2 is a graph which plots nip pressure distribution and surface velocity over nip area. For the case where there is zero drag on the media and idler roll 7, and if the coefficient of friction between media and drive roll is uniform throughout the nip, the following relationship exists:

$$\text{Area A} = \text{Area } B_1 + \text{Area } B_2.$$

This relationship is necessary in order for the sum of forces in the direction of media travel to equal zero. In area A, the surface of elastomer roll 6 slips forward on the media; in areas $B_1$ and $B_2$ it slips backward. both movements caused by the variation in elastomer roll surface strain through the nip The velocity of the media as it travels through the nip is determined by identifying the location where no slippage occurs. For this case, it would be at the interface of area A with area $B_1$ and $B_2$. By extending a vertical line from these locations to the surface velocity curve, media velocity is seen to be $V_1$. For the case where drag is applied to the media as it travels through the nip, the following relationship holds:

$$\text{Area A} = \text{Area } B_1 + \text{Area } B_2 + \text{Drag (FIG. 3)}$$

Once again, this relationship is necessary for the sum of forces in the direction of media travel to equal zero. As in the previous case, in area A, the surface of roll 6 slips forward on the media and in areas $B_1$ and $B_2$, it slips backward. For this case, the zero slip location will be further out towards the nip edges and the intersection with the surface velocity curve will result in a velocity $V_2$ which is slower than $V_1$ when the drag is zero.

For the prior art system shown in FIG. 1, and in the usual case where the media supply system does include a drag factor, the system will create an automatic self adjustment of media velocity so that both sets of rollers run at the same surface velocity. This is because the surface velocity of one nip will usually want to run faster and will assume a greater portion of the drag from the media supply roll than will the nip that wants to run slower. This uneven sharing of the system drag will cause the faster nip to slow down more than the slower nip. If the initial velocity difference is not too great and the drag on the media supply is great enough, the two nips will reach a common surface velocity and the system will be in equilibrium. The disadvantage of this prior art drive method is that it is difficult to accurately control the velocity at which the elastomer rolls drive the media. e.g. velocity $V_2$. Also, variations in system drag will affect media velocity. Parameters such as elastomer physical properties, thickness and temperature and pinch force can affect velocity by increasing surface strain on the roll at a location in the nip of zero slippage.

More accurate control of velocity can be obtained using high friction hard rolls in place of the elastomer rolls in FIG. 1. But this arrangement has the disadvantage in that it cannot self adjust to ensure that both pinch rollers are at the same velocity. This problem is accentuated when the media is being supplied from an "endless" roll supply.

Examining further the nature of the prior art use of an elastomer roll as a drive for a media travel system, because of the fact that the drive roll has an elastomer surface, its surface becomes strained in the area where it is in contact with the hard roll (the converse is not true). Due to the strain of the elastomer surface in the nip area, the effective circumference of the elastomer roll is increased; specific points located in the nip area are effectively elongated from their location in the non-nip area. The greater the nip pressure the greater the elongation of the elastomer surface in the nip area. What this means for media travel through the nip area is that the media travel increases in proportion to the increase in the nip pressure. This strain phenomenon makes it difficult if not impossible to accurately control the surface velocity (and thus media velocity) of an elastomer covered roll. In the description of the prior art configuration of FIG. 1, two elastomer rolls are used as drive rolls. because of the inherent variations in the two rolls (e.g. each elastomer coating will likely differ slightly in thickness from the other; diameters will likely differ slightly, effects of the strain phenomemon on surface velocity), these prior art systems suffer the inherent disadvantage that surface velocity in the nip area cannot be accurately controlled.

In fact, the surface velocity of one drive roll will likely be different from that of the other drive roll unless something intervenes to cause their surface velocities to be equal. The elastomer drive roll system of the present invention is designed to automatically distribute the drag forces, between roll pairs, in such a manner that each drive roll surface velocity will assume a greater portion of the drag and thus change velocity more than the other roll pair. More specifically, the present invention is directed at using one hard drive roll to eliminate the disadvantage of uncontrollable surface velocities of elastomer covered drive rolls while at the same time using one elastomer covered roll to take advantage of its ability to change surface velocity with drag. In a system with no drag, the elastomer roll would be designed to have a greater surface velocity than the hard roll. When drag is added to the media being driven, the elastomer covered roll will assume a portion of the total drag such that its surface velocity is reduced to match the surface velocity of the hard roll. The remainder of the drag will be assumed by the hard roll and the system will be in equilibrium, driving the media at the hard roll surface velocity. Thus, the rollers are driven on the same shaft, and the rotational speeds are identical, but because of the effective change in circumference in the nip area due to the strain of the elastomer coating, they have surface velocities in the nip area which are different than the surface velocities of non-elastomer rolls. System drag forces intervene to drive the system to an equilibrium condition. More specifically, the invention is directed to a feed roll system for feeding web media from a supply force along a feed path, the system including a first and second drive roll pair, in horizontal axial alignment along the feed path, said first drive roll pair including a hard, high friction drive roll in compressive relationship with a second, elastomer-coated idler roll, the first roll pair forming a first nip area therebetween, said second drive roll pair including an elastomer-coated, high friction drive roll in compressive relationship with a hard idler roll, the second roll pair forming a second nip area therebetween;

whereby said first drive roll pair controls the media velocity through said first nip area and said second roll pair adjusts its drive velocity through said second nip area to match that of said first drive pair.

DESCRIPTION OF THE INVENTION

Figure 4:
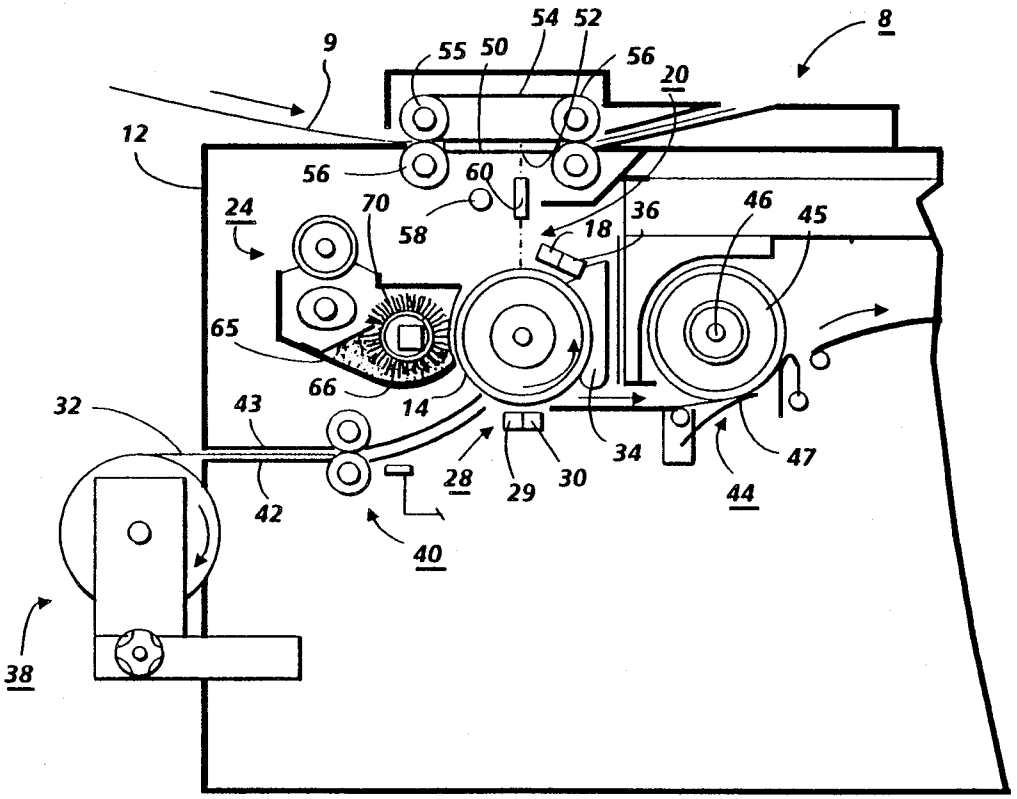
FIG. 4 is a side schematic view of a large document copier in which the present invention may be used.

Referring to FIG. 4 of the drawings, there is shown a xerographic type reproduction machine 8 incorporating the present invention. Machine 8 has a suitable frame 12 on which the machine xerographic components are operatively supported. Briefly, and as will be familiar to those skilled in the art, the machine xerographic components include a recording member, shown here in the form of a rotatable drum 14 having a photoconductive surface. Other photoreceptors, such as a belt or web may be used instead. Operatively disposed about the periphery of drum 14 is charge corotron 18 for placing a uniform charge on the photoconductive surface of drum 14; an exposure station 20 where the previously charged photoconductive surface is exposed to image rays of the document 9 being reproduced; development station 24 where the latent electrostatic image created on the photoconductive surface is developed by toner; transfer station 28 with transfer corotrons 29,30 for transferring the developed image to copy media 32 brought forward in timed relation with the developed image on the photoreceptor surface, and cleaning station 34 for removing leftover developer. Copy media 32, which, in a preferred embodiment is paper, is fed from media roll support assembly 38, and is brought forward by feed roll assembly 40 and fed between sheet guides 42,43. The feed roll assembly is described in further detail below. Following transfer, the media 32 is carried forward to a fusing station 44 where the toner image is fixed by fusing roll 45 in cooperation with a biased flexible web 47. Fusing roll 45 is heated by a suitable heater such as lamp 46 disposed within the interior of roll 45. After fixing, the media 32 is conveyed to a separate output station (not shown) where the media is cut into appropriate sized image frames and, if desired, rolled into cylindrical form for easier handling.

Continuing with the description of machine 8, transparent platen 50 supports the documents 9 as the document is moved past a scan point 52 by a constant velocity transport 54. As will be understood, scan point 52 is, in effect, a scan line extending across the width of platen 50 at a desired point where the document is scanned line-by-line. Transport 54 has input and output document feed roll pairs 55,56, respectively, on each side of scan point 52 for moving a document 9 across platen 50 at a predetermined speed. Exposure lamp 58 is provided to illuminate a strip-like area of platen 50 at scan point 52. The image rays from the document line scanned are transmitted by a gradient index lens array 60 to exposure station 20 to expose the photoreceptor surface of the moving photoreceptor drum 14.

Developing station 24 includes a developer housing 65, the lower part of which forms a sump 66 for holding a quantity of developer. A rotatable magnetic brush developer roll 70 is disposed in predetermined operative relation to the photoconductive surface. In developer housing 65, roll 70 serves to bring developer from sump 66 into developing relation with drum 14 to develop the latent images formed on the surface thereof.

In the preferred embodiments, documents 9 represents a large (36 inch) engineering drawing. The width of the photoreceptor and the dimensions of the developer, transfer, cleaning, fusing and media roll support assembly are of like dimensions.

Figure 1:
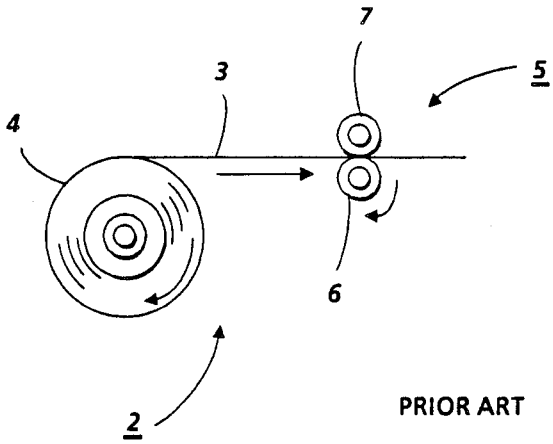
FIG. 1 is a side view of a prior art media feed system having two drive nips across the media web formed by two sets of drive rolls.
Figure 5:
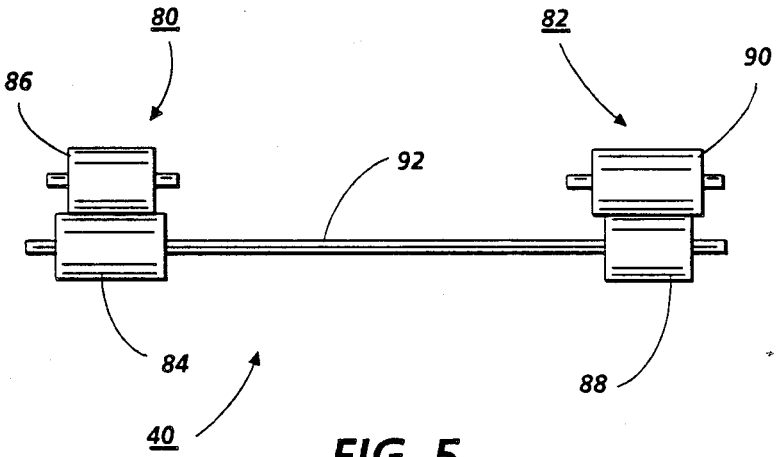
FIG. 5 is an end view of the web feed system of FIG. 4.
Figure 2:
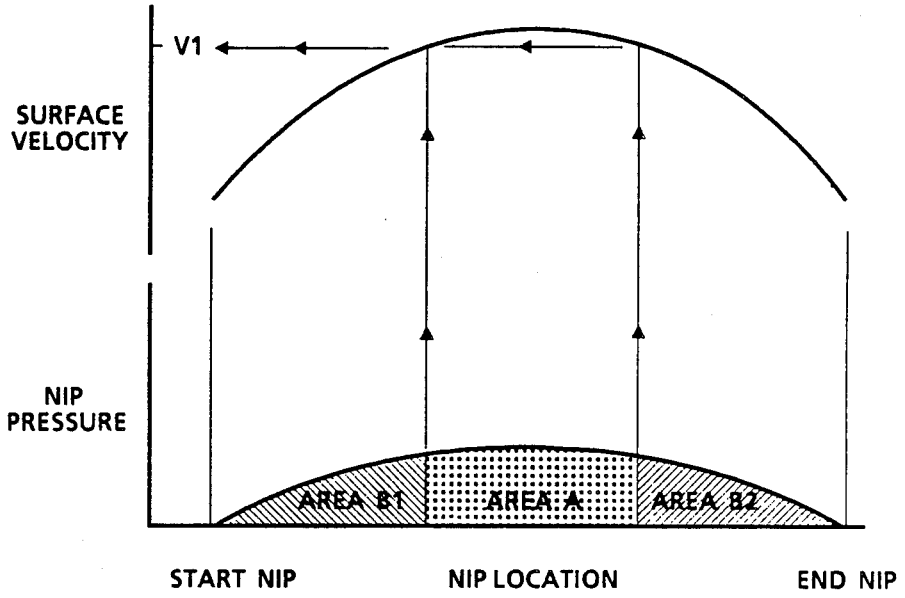
FIG. 2 is a graph showing the relationship of nip pressure and surface velocity for the drive rolls of FIG. 1 for the case where drag on the media is equal to zero.
Figure 3:
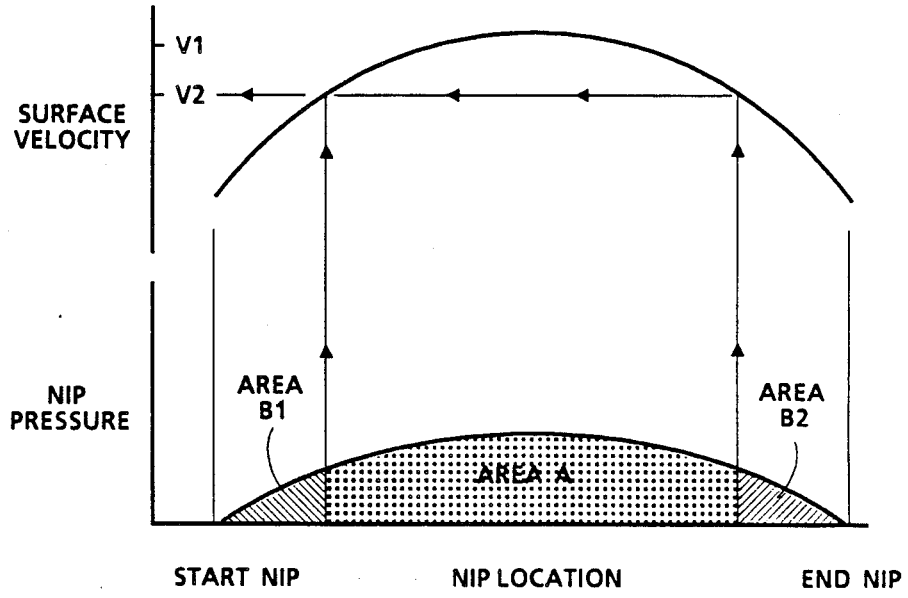
FIG. 3 shows the graph of FIG. 2 with the relationships affected by introduction of a drag factor.

Turning now to the feed roll assembly 40, shown in end view in FIG. 5, the assembly consists of a first roll pair 80 and a second roll pair 82. Roll pair 80 includes a hard, high friction drive roll 84 and an elastomercovered idler roll 86. Roll pair 82 consists of an elastomer-covered, high friction roll 88 and a hard idler roll 90. Rolls 84 and 88 are secured to a common drive shaft 92. Elastomer roll 88 is designed so that, when there is no drag on the media, it drives the media at a velocity greater than the velocity imparted to the media by hard driver roll 84. When drag is added to the media, roll 88 starts to absorb the drag since its tendency is to drive the media faster than the roll 84. As roll 88 assumes the media drag, its drive velocity slows down (as described in the discussion above related to the graph of FIG. 3). When the velocity of roll 88 slows to match the velocity of roll 84, roll 88 assumes no more of the media drag, the remaining drag being assumed by roll 84. Thus, the high friction drive roll 84 controls the media velocity very accurately and the elastomer roll 88 self-adjusts its drive velocity to match that of roll 84. In a preferred embodiment, roll 90 consists of a roll made from a hard material that rotates freely against drive roll 88. Roll 88 consists of a roll containing a metal core covered with a thick, high friction elastomer layer. Roll 86 contains a hard core covered with an elastomer. It rotates freely against drive roll 84. Roll 84 is a hard roll containing a high friction surface formed, for example, by flame spray or grit blast.

As a further design consideration, and as shown in FIG. 5, elastomer covered rolls 86 and 88 are shorter in length than the hard rollers so as to prevent deformation of an overhanging elastomer edge into the paper path.

Other changes and modifications may be possible consistent with the principles of the present invention. For example, although the invention is shown in a system for feeding large size media of unlimited length from a feeder roll, it is also suitable for feeding other types of media. All such changes are intended to be embraced by the following claims.

What is claimed is:

1. A feed roll system for feeding web media from a supply source along a feed path, the system including a first and second drive roll pair, in horizontal, axial alignment along the feed path, said first drive roll pair including a hard, high friction drive roll in compressive relationship with an, elastomer-covered idler roll, the first roll pair forming a first nip area therebetween, said second drive roll pair being axially spaced from said first drive roll pair and including an elastomer-covered, high friction drive roll in compressive relationship with a hard roller, the second roll pair forming a second nip area therebetween, whereby said first drive roll pair controls the media velocity through said first nip area and said second roll pair adjusts its drive velocity through said second nip area to match that of said first drive pair.

2. The feed roll system of claim 1 wherein said elastomer-covered, high friction drive roll comprises a metal core covered with a thick, high friction elastomer layer.

3. The feed roll system of claim 1 wherein said elastomer covered rolls are shorter in length then said opposed high roll.

* * * * *